US009142350B2

(12) United States Patent
Pinkerton

(10) Patent No.: US 9,142,350 B2
(45) Date of Patent: Sep. 22, 2015

(54) SYNTHESIS OF ORDERED L10-TYPE FENI NANOPARTICLES

(71) Applicant: GM GLOBAL TECHNOLOGY OPERATIONS LLC, Detroit, MI (US)

(72) Inventor: Frederick E. Pinkerton, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 286 days.

(21) Appl. No.: 13/798,292

(22) Filed: Mar. 13, 2013

(65) Prior Publication Data

US 2014/0271324 A1 Sep. 18, 2014

(51) Int. Cl.

| | |
|---|---|
| ***B22F 9/14*** | (2006.01) |
| ***H01F 41/02*** | (2006.01) |
| ***H01F 1/06*** | (2006.01) |

(52) U.S. Cl.

CPC ..... *H01F 41/0266* (2013.01); *B22F 9/14* (2013.01); *H01F 1/068* (2013.01)

(58) Field of Classification Search

None

See application file for complete search history.

(56) References Cited

U.S. PATENT DOCUMENTS

| | | | | |
|---|---|---|---|---|
| 5,147,448 | A * | 9/1992 | Roberts et al. | 75/331 |
| 7,888,284 | B2 * | 2/2011 | Kutushov | 502/400 |
| 2011/0252923 | A1 * | 10/2011 | Nakamura et al. | 75/351 |

* cited by examiner

*Primary Examiner* — George Wyszomierski

(74) *Attorney, Agent, or Firm* — Reising Ethington P.C.

(57) ABSTRACT

Particles of iron and nickel are added to a flowing plasma stream which does not chemically alter the iron or nickel. The iron and nickel are heated and vaporized in the stream, and then a cryogenic fluid is added to the stream to rapidly cause the formation of nanometer size particles of iron and nickel. The particles are separated from the stream. The particles are preferably formed as single crystals in which the iron and nickel atoms are organized in a tetragonal $L1_0$ crystal structure which displays magnetic anisotropy. A minor portion of an additive, such as titanium, vanadium, aluminum, boron, carbon, phosphorous, or sulfur, may be added to the plasma stream with the iron and nickel to enhance formation of the desired crystal structure.

20 Claims, 1 Drawing Sheet

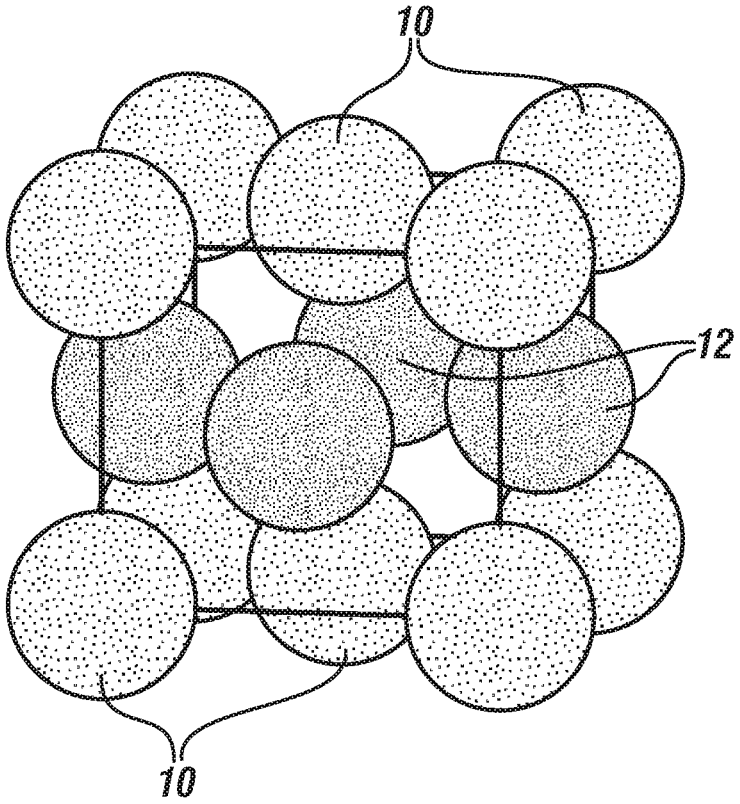
10
12
10

SYNTHESIS OF ORDERED L10-TYPE FENI NANOPARTICLES

This invention was made with U.S. Government support under Agreement No. DE-AR0000186 awarded by the Department of Energy. The U.S. Government may have certain rights under this invention.

TECHNICAL FIELD

This invention pertains to the formation of nanometer size particles of iron-nickel alloys in which the iron and nickel atoms are arranged in the tetragonal $L1_0$ crystal structure. Mixtures of iron and nickel atoms are formed in their vapor state and the iron-nickel vapor is cooled very rapidly to form nanometer size particles in which the iron and nickel atoms are organized in the tetragonal $L1_0$ crystal structure.

BACKGROUND OF THE INVENTION

There is a continuing need for relatively inexpensive, high performance permanent magnet materials. For example, in the automotive vehicle industry there is a particular need for such permanent magnet materials, having relatively high curie temperatures Tc (>300° C.), in traction motors, generators, and other applications.

Iron-nickel alloys are believed to offer permanent magnet properties providing they can be formed in the tetragonal $L1_0$ crystal structure. There is a need to form very small particles of compositions of elemental iron and nickel that may be consolidated into unitary shapes to serve as permanent magnets. Iron (atomic number 26) and nickel (atomic number 28) are similarly-sized transition element atoms. A molten mixture of elemental iron and nickel may be solidified as a face-centered cubic (fcc) crystal structure with the iron and nickel atoms in a disordered arrangement. But the disordered fcc crystal structure of iron and nickel atoms does not provide the magnetic anisotropy that is necessary for permanent magnet properties. There is a need for a method by which iron and nickel atoms may be formed into nanometer size particles of iron-nickel alloys in which the iron and nickel atoms are arranged in layers such that the resulting crystals are not cubic, but tetragonal and in the $L1_0$-type AuCu 1 crystal structure to provide magnetic anisotropy.

SUMMARY OF THE INVENTION

This invention provides a method for forming nanometer size particles of iron and nickel having a $L1_0$-type tetragonal crystal structure. When prepared in this crystal structure the iron-nickel composition particles are magnetically anisotropic and have useful permanent magnet properties.

In accordance with the invention, solid particles of iron and nickel are introduced into a process medium which is initially a plasma or plasma stream and which quickly heats the particles to form a vapor of iron and nickel atoms. The plasma is suitably formed, as in a DC plasma torch, from a neutral material such as nitrogen that does not chemically react with iron or nickel during their residence in the plasma processing medium. Preferably, the plasma is an element that is not condensable to a liquid at a temperature above 25° C. The plasma is initially at a temperature of many thousand degrees Kelvin, for example, 10,000 Kelvin, and a vapor of a mixture of iron and nickel is quickly formed. A very cold (below about 100K), inert fluid, such as liquid argon, or its vapor, is introduced into the plasma processing medium, containing iron-nickel vapor, to cool the iron-nickel mixture very rapidly to a temperature below 300° C. The vapor mixture of iron and nickel is rapidly transformed into particles of iron and nickel having a particle size smaller than about 250 nanometers. This process is utilized to quickly form and separate particles in which iron and nickel atoms are organized as successive layers of iron atoms and of nickel atoms in the arrangement characteristic of the $L1_0$-type tetragonal crystal structure.

Preferably, each quenched particle consists of a single crystal of the iron and nickel atoms in the tetragonal $L1_0$ crystal structure. But, if necessary, particles that are partly amorphous, or have a high density of crystallographic defects such as dislocations may be carefully heat treated in an inert gas atmosphere to complete crystal formation. The heat treatment may be performed in the presence of an applied magnetic field in order to impose a preferential direction for formation of the $L1_0$ structure. But the particles must not be heated to a temperature (above about 320° C.) at which the crystal structure may convert to a disorganized crystal arrangement of the iron and nickel atoms. The nanometer size particles are collected and available for consolidation into a desired magnet body shape.

In accordance with a preferred embodiment of the invention, a flowing plasma stream is generated like that, for example, produced in a DC plasma generator or torch. A steady stream is established in a defined flow path. The plasma stream may have a generally circular cross-section. Solid pieces or particles of iron and nickel are introduced into the plasma stream. Preferably, but not necessarily, iron and nickel particles are introduced separately into the plasma, each at a plurality of locations around the perimeter of the flowing stream. The iron and nickel materials are quickly vaporized and mixed in the flowing plasma stream.

When the vapor/plasma process stream has been suitably established, a cryogenic fluid, such as liquid argon or liquid helium, is introduced into the vapor steam in an amount suitable to quench the iron-nickel vapor and form nanometer-size particles of iron and nickel composition. It is intended that the particles be cooled to a temperature below about 300° C. in the quench zone. As the quench fluid is added, the composite flowing stream may be confined and narrowed in cross-section so as to facilitate separation of the iron-nickel particles from the stream, and their recovery. The quenchant may also be separately recovered.

Preferably the additions of iron and nickel to the plasma processing stream are managed to produce single crystal particles of FeNi no larger than about 250 nm in size. In general, it is preferred that nickel constitutes about 25 to 67 weight percent of iron and nickel content of the particles. In one embodiment it is preferred that nickel constitutes about 45 to 55 weight percent of the iron and nickel content of the particles, and in another embodiment it is preferred that nickel constitutes about 25 to 39 weight percent of the iron/nickel content.

A minor amount of an additive element (A) may be included in the iron and nickel materials introduced into the plasma processing medium. Preferably, A is one or more of the elements selected from the group consisting of titanium, vanadium, aluminum, boron, carbon, phosphorus, and sulfur. The overall iron, nickel, and additive combination is to comprise no more than about fifteen weight percent of A and, preferably, no more than about ten weight percent A. The additive may be used in an amount to stabilize the formation of the iron/nickel combination in its tetragonal $L1_0$ crystal phase.

Accordingly, a method is provided to form a mixture of iron, nickel, and optionally an additive, convert it to a vapor mixture, and rapidly condense nanometer size particles of an organized arrangement of atoms having the tetragonal $L1_0$ crystal structure. The particles may be consolidated into suitable magnet body shapes by practices such as sintering, hot pressing, hot deformation, spark plasma sintering, or the like. A magnetic field may be applied prior to consolidation to magnetize and align the particles. Alternatively, the particles may be consolidated and the solid body magnetized after consolidation. In either case, complex magnetization patterns (e.g., magnetic poles) may be imposed on the solid compact after consolidation using an appropriate magnetizing fixture.

Other objects and advantages of the invention will be apparent from a description of illustrative embodiments of the practice of the invention.

BRIEF DESCRIPTION OF THE DRAWINGS

The drawing FIGURE is an enlarged schematic illustration of an organized layered arrangement of iron atoms 10 and nickel atoms 12 in a single cell of a $L1_0$ tetragonal crystal structure. In this illustration, each layer of atoms of the crystal cell is filled with either iron atoms or nickel atoms. Because of the slightly different sizes of the iron and nickel atoms, the cell is tetragonal. This organized layered arrangement of the iron and nickel atoms provides their $L1_0$ tetragonal crystals with magnetocrystalline anisotropy. In this illustration, the preferred magnetic direction of the crystal cell is in the vertical direction. The use of additive atoms in the practice of the invention (not illustrated in the drawing FIGURE) serves to enhance or stabilize this basic arrangement of the iron and nickel atoms in the basic $L1_0$ tetragonal crystal structure.

DESCRIPTION OF PREFERRED EMBODIMENTS

In one aspect of the present invention, a method is provided to convert particles of iron and nickel, or particles of an alloy of iron and nickel, using vapor phase and quench processing into nanometer size particles of single-crystals of iron and nickel atoms which are organized in a $L1_0$ tetragonal crystal structure.

The method comprises the formation of a plasma volume or stream, created using a composition that does not react chemically with the iron or nickel. Preferably, but not necessarily, the plasma is formed and used as a flowing high temperature stream to which the iron, nickel, and additive elements, if used, are added. The plasma may be formed from a suitable gas that does not chemically alter the iron or nickel. The gas may be, for example, helium, argon or nitrogen. The plasma initially is at a very high temperature of the order of several thousand degrees Kelvin. The plasma is used in the present process to form a high temperature processing medium into which iron and nickel particles are added and vaporized to form a quenchable mixture. As described above in this specification, the vapor mixture is maintained only for a brief period of time and is then quenched to condense the iron, nickel, and any additive atoms as a solid mixture in the form of very small particles. In general, it is preferred to use the plasma in the form of a flowing process stream with a generally round cross-section, or like perimeter, to facilitate the addition of the starting particles at a plurality of locations around the circumference of the plasma stream.

Thermal plasmas are often generated in plasma torches when a flowing gas is energized by an electrical discharge, such as a direct current (DC), alternating current (AC), or radio frequency (RF) discharge. A plasma stream in the nature of a DC torch stream is suitable for use as the high temperature processing stream. In a typical DC plasma generator, a gas stream of nitrogen (e.g.) is flowed through a circular tube, along an axial cathode toward an anode ring near the outlet of the tube. A high voltage DC arc discharge is maintained between the downstream end of the axial cathode, near the anode ring. As the nitrogen passes through the DC discharge at a suitable flow rate, it is converted into a highly ionized gas; a plasma. The use of a plasma processing stream is preferred in the practice of this invention because the flowing stream may be quickly and effectively utilized to receive additions of iron, nickel, and additive, to affect their conversion to a mixed vapor, and to accommodate the quenching of the vapor to recover very small, rapidly solidified particles of the permanent magnet material. Accordingly, it is preferred that the stream is established with a generally circular cross-section. Thus, the plasma stream may be enclosed or otherwise formed with a defined periphery, suitable for the addition of the iron, nickel, and any additive solids to be processed.

Thus, as soon as the plasma processing stream has been established, it is utilized. Suitable amounts and proportions of iron and nickel particles are injected into the high temperature stream so that they are quickly melted and vaporized. In general it is preferred to utilize the plasma processing stream by introducing the solid materials at several locations around the periphery of the stream and, if necessary, along the flow path of the plasma stream. In a preferred embodiment, iron particles and nickel particles are separately introduced into the plasma stream. When the product is to contain an additive element or elements it may be preferred to pre-form alloys of the iron, nickel, and additive(s). The materials may be added, for example, in predetermined proportions by pushing individual or alloyed particles through feed tubes into the flowing plasma stream. Of course, the rate of addition of the iron and nickel must be in proportion to the capacity of the plasma stream to receive them and immediately melt them to form a vapor of the metal elements to be mixed. Thus, a continuous length-wise portion of the flowing plasma processing stream is utilized to receive and rapidly melt and vaporize the predetermined combinations of iron, nickel, and any additive elements to be prepared as a vapor suitable for quenching. Depending on the predetermined thermal capacity of the plasma process stream, less than a meter or so of its flowing length may be required for this step of the process.

When a suitable vaporized mixture of the elements has been formed, the mixed vapor is quenched to recover the added elements in the form of small solid iron-nickel-based particles. By this stage of the process, the initially plasma material may have cooled into a high temperature gas that is carrying the metal vapor. Again, the generally confined perimeter of the flowing process stream may be utilized for the effective addition of a very low temperature (cryogenic) quench fluid into the stream. Preferably, the quench fluid is directed into the process fluid in several radially inwardly-directed streams applied from the circumference or perimeter of the flowing process stream.

Liquid argon (initially at about 83 Kelvin) is a preferred quench fluid. Of course, argon has a very narrow liquid temperature range and will soon be converted to a vapor as it encounters the plasma process stream. Liquid helium or liquid nitrogen may also be used as a quench fluid. In order to better utilize the quench fluid and the process stream, it is preferred to add quench fluid from a plurality of locations around the perimeter of the flowing process stream.

The addition of the quench fluid increases the mass of the flowing stream as it is cooled. If the flowing process stream has not been physically combined within a tube or the like to preserve its thermal content, the quenched process stream may now be directed into a confining tube or the like. The cross-section of the process stream may initially be allowed to expand and cool. But it is then desired to funnel or narrow the stream in which the solid particles of iron and nickel are being formed. This is to facilitate separation of the precipitated iron-nickel-additive particles from the process stream. It is, of course, desirable to completely recover all metal added to the plasma stream. This may be accomplished by passing the channeled, particle-containing, process stream through a suitable filter or centrifuge.

It is also generally desirable to recover the argon or other quench material for reuse. It may also be desirable to recover the working gas used to form the plasma.

The practice of the described process is to form generally uniformly-sized particles of $(Fe_{100-x}Ni_x)_{100-y}A_y$ composition where the particles are no larger than about 250 nanometers in diameter or largest dimension. A representative sample of the particles may be examined and characterized by X-ray diffraction.

Preferably, the particles consist of single crystals of the $(Fe_{100-x}Ni_x)_{100-y}A_y$ composition and in the tetragonal $L1_0$ crystal structure. A schematic illustration of a single crystal cell is presented in the drawing FIGURE. It is seen that alternate layers of the cell consist of iron atoms 10 and nickel atoms 12. Ideally, this alternate layer arrangement of the iron and nickel atoms, with interspersed additive atoms (if included) would continue throughout the cells of a single crystal particulate material If the quenched particles are not fully crystallized, they may be heat treated in an inert atmosphere at a temperature below about 300° C. for a time determined experimentally, or by experience, to complete the crystallization of the quenched particles. Other methods of inducing complete crystallization in the recovered particles include pressurization under a suitable gas, or application of an applied magnetic field, or combinations of the above, such as heat treatment in the presence of an applied magnetic field. Also mechanical processing of the particles such as rolling, swaging, or ball milling of the particles may be utilized to complete crystallization in the small particles. Combinations of these practices may also be used to induce further crystallization.

The process is conducted to obtain the $(Fe_{100-x}Ni_x)_{100-y}A_y$ composition in the form of particles having the magnetically anisotropic, tetragonal, $L1_0$ crystal structure. Preferably, each particle is a single crystal of the desired structure. As stated it is preferred that the nickel content of the iron-nickel mixture be, by weight, 25 to 67 percent of the total of iron and nickel; x=25-67. Within the overall preferred proportions of iron and nickel are two preferred sub-ranges by weight which are found to reflect good combinations of iron and nickel. These weight ranges are reflected by x=45 to 55 weight percent Ni and x=25 to 39 weight percent Ni.

When one or more additives (A) are added with the iron and nickel, it is preferred that y be no greater than 15 percent by weight of the total of Fe, Ni, and A. More preferably, it is preferred that y be less than or equal to 10% by weight. It is preferred that an additive, A, is selected to be one or more elements selected from the group consisting of Ti, V, Al, B, C, P, and S.

In many permanent magnet applications it will be necessary to consolidate the iron-nickel particles into permanent magnet body shapes for use in electric motors, magnetic actuators, and the like. Such consolidation may be accomplished by any of many suitable methods which do not adversely affect the desired tetragonal $L1_0$ crystal structure of the particles. A permanent magnet may be formed by magnetizing and magnetically aligning the particles prior to consolidation, or by magnetizing the solid body in its entirely, or in regions, after consolidation is complete.

Practices of the invention have been disclosed as specific illustrations which are not intended to limit the proper scope of the invention.

The invention claimed is:

1. A method of forming small particles with permanent magnet properties and consisting essentially of iron and nickel, and optionally one or more additive elements (A) selected from the group consisting of titanium, vanadium, aluminum, boron, carbon, phosphorous, and sulfur in accordance with the formula, $(Fe_{100-x}Ni_x)_{100-y}A_y$, where x equals weight percent of nickel in combination with iron and has a value in the range of 25-67 weight percent, and y equals weight percent of an additive A incorporated with the combination of iron and nickel, and has a value of no more than fifteen weight percent; the method comprising:

adding iron and nickel atoms and, optionally, atoms of an additive A into a flowing process stream, which is initially a plasma stream, to produce a vapor in the process stream comprising a mixture of the added atoms, the plasma being formed of a material that is not condensable to a liquid at a temperature above 25° C.; thereafter adding a quench fluid, initially at a temperature below about 100K, into the process stream, the quench fluid mixing with the process stream and being added in an amount to quench the iron, nickel, and additive atoms of the vapor in the process stream to form particles of the iron, nickel, and additive atoms at a temperature below about 300° C., the particles having a size of about 250 nanometers or smaller;

separating the particles from the process stream; and, if the formed and separated particles are not fully crystallized to a tetragonal $L1_0$ crystal structure, then heating the separated particles such that the iron, nickel, and A are arranged in a tetragonal $L1_0$ crystal structure.

2. A method as stated in claim 1 in which the plasma is formed from an inert gas or a gas that is not reactive with the iron, nickel, or A atoms in the plasma.

3. A method as stated in claim 1 in which the quench fluid composition is one of argon, helium, or nitrogen, and is added to the process stream as a cryogenic fluid.

4. A method as stated in claim 1 in which the flowing process stream is directed in a flow path with a perimeter or perimeters, and iron and nickel atoms are added separately into the processing stream at more than one location around the perimeter and along the flow path of the process stream.

5. A method as stated in claim 1 in which the process stream is directed in a flow path with a perimeter and the quench fluid is added to the process stream at more than one location around the perimeter of the flow path of the process stream.

6. A method as stated in claim 1 in which the process stream is directed in a flow path with a perimeter and the process steam is caused to converge after the addition of the quench fluid to concentrate the formed particles for their separation from the process stream.

7. A method as stated in claim 1 in which x has a value in the range of 45 to 55 weight percent nickel.

8. A method as stated in claim 1 in which x has a value in the range of 25 to 39 weight percent nickel.

9. A method as stated in claim 1 in which the iron, nickel, and additive A are mixed in an alloy before being added to the process fluid.

10. A method as stated in claim 1 in which the separated particles with the tetragonal $L1_0$ crystal structure are subjected to a combination of consolidation and magnetization to form an article having permanent magnet properties.

11. A method as stated in claim 1 in which heating of the separated particles is done in combination with one or more of (a) the application of pressure to the particles, (b) the application of a magnetic field to the particles, and (c) mechanical working of the particles.

12. A method of forming small particles with permanent magnet properties and consisting essentially of iron and nickel, and optionally one or more additive elements (A) selected from the group consisting of titanium, vanadium, aluminum, boron, carbon, phosphorous, and sulfur in accordance with the formula, $(Fe_{100-x}Ni_x)_{100-y}A_y$ where x equals weight percent of nickel in combination with iron and has a value in the range of 25-67 weight percent, and y equals weight percent of an additive A incorporated with the combination of iron and nickel, and has a value of no more than fifteen weight percent; the method comprising:

adding iron and nickel atoms and, optionally, atoms of an additive A into a flowing process stream which is directed in a flow path with one or more perimeters, the process stream initially being a plasma stream, to produce a vapor in the process stream comprising a mixture of the added atoms, the plasma being formed of a material that is not condensable to a liquid at a temperature above 25° C., the iron and nickel atoms being added separately into the processing stream at more than one location around the perimeter and along the flow path of the process stream; thereafter adding a quench fluid, initially at a temperature below about 100K, into the process stream, the quench fluid being added to the process stream at more than one location around the perimeter of the flow path of the process stream, the quench fluid mixing with the process stream and being added in an amount to quench the iron, nickel, and additive atoms of the vapor in the process stream to form particles of the iron, nickel, and additive atoms at a temperature below about 300° C., the particles having a size of about 250 nanometers or smaller;

separating the particles from the processing stream; and, if the formed and separated particles are not fully crystallized to a tetragonal $L1_0$ crystal structure, then heating the separated particles such that the iron, nickel, and A are arranged in a tetragonal $L1_0$ crystal structure.

13. A method as stated in claim 12 in which the plasma is formed from an inert gas or a gas that is not reactive with the iron, nickel, or A atoms in the plasma.

14. A method as stated in claim 12 in which the quench fluid composition is one of argon, helium, or nitrogen, and is added to the process stream as a cryogenic liquid.

15. A method as stated in claim 12 in which the process stream is directed in a flow path with a perimeter and the process steam is caused to converge after the addition of the quench fluid to concentrate the formed particles for their separation from the process stream.

16. A method as stated in claim 12 in which x has a value in the range of 45 to 55 weight percent nickel.

17. A method as stated in claim 12 in which x has a value in the range of 25 to 39 weight percent nickel.

18. A method as stated in claim 12 in which the iron, nickel, and additive A are mixed in an alloy before being added to the process fluid.

19. A method as stated in claim 12 in which the separated particles with the tetragonal $L1_0$ crystal structure are subjected to a combination of consolidation and magnetization to form an article having permanent magnet properties.

20. A method as stated in claim 12 in which heating of the separated particles is done in combination with one or more of (a) the application of pressure to the particles, (b) the application of a magnetic field to the particles, and (c) mechanical working of the particles.

* * * * *